US011230826B2

(12) United States Patent
Sharma

(10) Patent No.: US 11,230,826 B2
(45) Date of Patent: Jan. 25, 2022

(54) NOISE BASED SETTLING DETECTION FOR AN IMPLEMENT OF A WORK MACHINE

(71) Applicant: Caterpillar Inc., Peoria, IL (US)

(72) Inventor: Amit Sharma, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 175 days.

(21) Appl. No.: 16/751,662

(22) Filed: Jan. 24, 2020

(65) Prior Publication Data

US 2021/0230844 A1 Jul. 29, 2021

(51) Int. Cl.
*E02F 9/26* (2006.01)

(52) U.S. Cl.
CPC ..... *E02F 9/265* (2013.01)

(58) Field of Classification Search
None
See application file for complete search history.

(56) References Cited

U.S. PATENT DOCUMENTS 4,805,086 A * 2/1989 Nielsen ..... E02F 3/435 172/4.5
4,920,305 A 4/1990 Benson et al.
6,098,322 A * 8/2000 Tozawa ..... E02F 9/2292 37/414
6,233,511 B1 5/2001 Berger et al.
8,915,308 B2 12/2014 Joergensen et al.
9,551,133 B2 * 1/2017 Ikegami ..... F15B 15/2815
10,011,974 B2 * 7/2018 Zhang ..... E02F 9/2041
2013/0166143 A1 * 6/2013 Seki ..... G01S 19/42 701/34.4
2019/0113057 A1 * 4/2019 Olsson ..... E02F 3/966

FOREIGN PATENT DOCUMENTS

WO 2015158951 A1 10/2015

* cited by examiner

*Primary Examiner* — Jonathan M Dager
*Assistant Examiner* — Garrett F Evans
(74) *Attorney, Agent, or Firm* — Harrity & Harrity LLP

(57) ABSTRACT

A control device may obtain data related to at least one position of an implement of a work machine that has moved to a set position. The control device may identify one or more first noise amplitudes associated with the data and may determine, based on the one or more first noise amplitudes, a noise band related to the implement vibrating at the set position. The control device may identify one or more second noise amplitudes associated with the data and may determine, based on the noise band and the one or more second noise amplitudes, that the implement has settled at the set position. The control device may allow, based on determining that the implement has settled at the set position, the implement to move to another position.

20 Claims, 5 Drawing Sheets

NOISE BASED SETTLING DETECTION FOR AN IMPLEMENT OF A WORK MACHINE

TECHNICAL FIELD

The present disclosure relates generally to calibrating an implement of a work machine and to determining that the implement has settled at a set position to facilitate calibration of the implement.

BACKGROUND

Various types of machines used, for example, in the construction industry, include implements, such as a blade, a bucket, and/or the like to perform one or more operations. An operator of the machine may interact with operator controls of the machine to cause the implement to move in a particular direction (e.g., move up, down, to the right, to the left, and/or the like; rotate clockwise and/or counterclockwise; and/or the like). However, the implement may not perform properly (e.g., the implement may move faster or slower than desired) if the implement is not calibrated correctly.

In many cases, as part of a calibration process, the implement may move from a first set position (e.g., a first stationary position) to a second set position (e.g., a second stationary position). After the implement moves to the second set position, the implement may vibrate for a particular amount of time before settling (e.g., ceasing to vibrate) at the second set position. To ensure proper calibration, the implement should not be moved to a third set position until the implement settles at the second set position. However, due to additional vibrations generated by operation of the machine and/or components of the machine, accurately determining when the implement has settled at the second position can be difficult.

One attempt to facilitate implement control based on noise values is disclosed in U.S. Pat. No. 10,011,974 to Zhang et al., issued on Jul. 3, 2018 ("the '974 patent"). In particular, the '974 patent discloses a machine controller that generates a noise value that is based on an error between an adaptive signal (e.g., that is indicative of a measured position of an earthmoving implement relative to a given operational terrain) and a target position signal (e.g., that is indicative of a target position of the earthmoving implement). The machine controller of the '974 patent locks an implement control gain value (e.g., that is associated with a speed of movement of the earthmoving implement) when the noise value is at an acceptable noise level. The machine controller of the '974 patent adjusts the control gain value to control the implement speed when the noise value is at an unacceptable noise level until the noise value is at the acceptable noise level, and the implement control gain value is locked. Per the '974 patent, the machine controller operates the earthmoving machine based on the locked implement control gain value.

While the machine controller of the '974 patent may be effective at controlling a speed of an implement based on a noise value that indicates an error between a measured position of an earthmoving implement and a target position of the earthmoving implement, the '974 patent does not disclose determining when an implement has settled at a set position. The system of the present disclosure solves one or more of the problems set forth above and/or other problems in the art.

SUMMARY

According to some implementations, a method may include obtaining data related to at least one position of an implement of a work machine that has moved to a set position; identifying one or more first noise amplitudes associated with the data; determining, based on the one or more first noise amplitudes, a noise band related to the implement vibrating at the set position; identifying one or more second noise amplitudes associated with the data; determining, based on the noise band and the one or more second noise amplitudes, that the implement has settled at the set position; and allowing, based on determining that the implement has settled at the set position, the implement to move to another position.

According to some implementations, a method may include obtaining a signal that includes a plurality of signal values associated with a component; identifying one or more first noise amplitudes associated with the signal; determining, based on the one or more first noise amplitudes, a noise band related to the signal; identifying one or more second noise amplitudes associated with the signal; determining, based on the noise band and the one or more second noise amplitudes, that the signal has settled at a particular signal value; and permitting, after determining that the signal has settled at a particular signal value, the component to move from a first position to a second position.

According to some implementations, a method may include causing an implement of a work machine to move to a set position; obtaining, after causing the implement to move to the set position, data related to the implement being at the set position; storing one or more data elements of the data in a data structure, wherein each data element is included in a respective entry in the data structure; identifying, based on a first set of entries of the data structure, one or more first noise amplitudes associated with the data; determining, based on the one or more first noise amplitudes, a noise band related to the implement being at the set position; identifying, based on a second set of entries of the data structure, one or more second noise amplitudes associated with the data; determining, based on the noise band and the one or more second noise amplitudes, that the implement has settled at the set position; and permitting, after determining that the implement has settled at the set position, the implement to move to another position.

DETAILED DESCRIPTION

Figure 1:
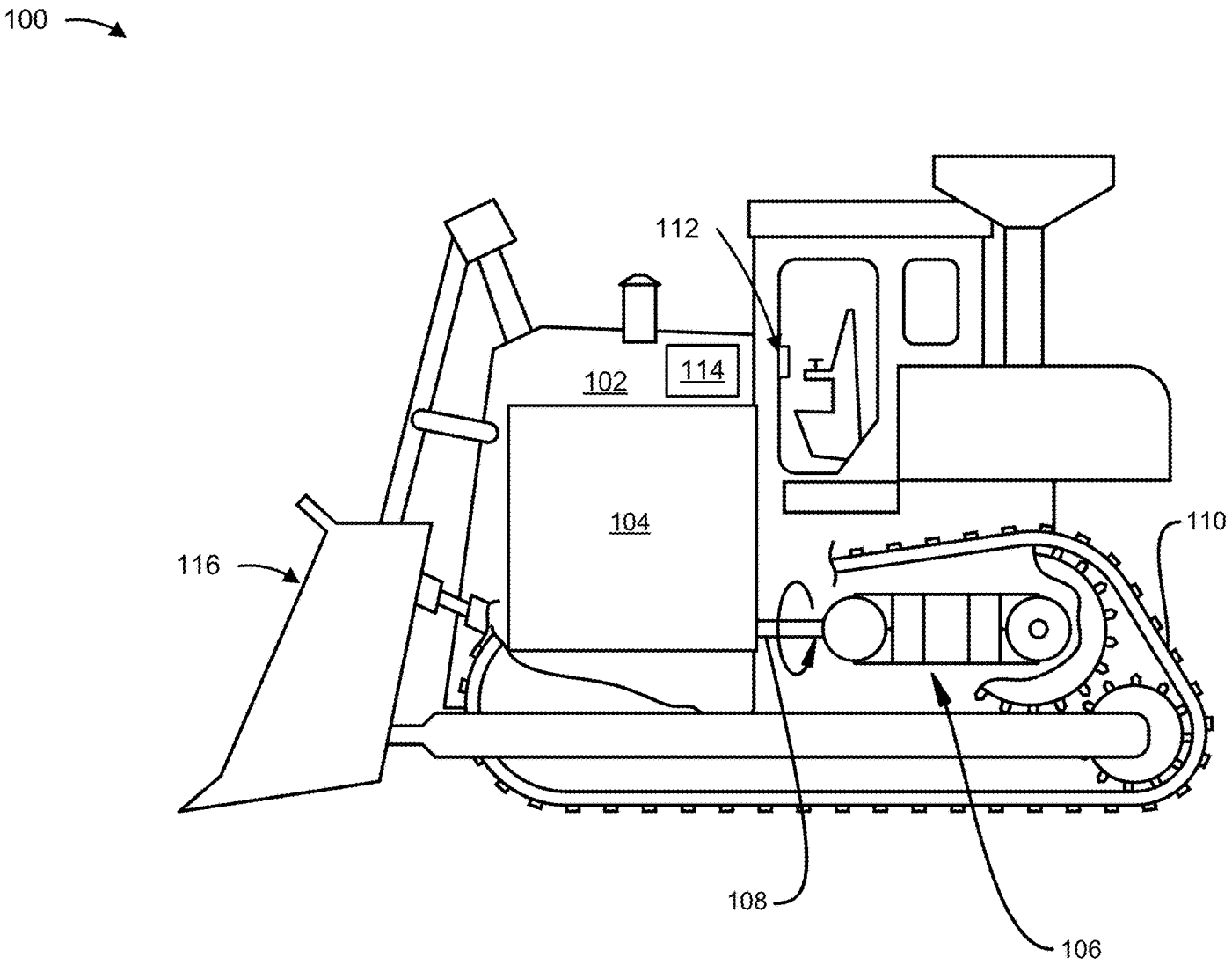
FIG. 1 is a diagram of an example machine described herein.

FIG. 1 is a diagram of an example machine 100 described herein. The term "machine" or "work machine" may refer to any machine that performs an operation associated with an industry such as, for example, mining, construction, farming, transportation, or any other industry. For example, the machine 100 may include a mobile machine, such as a track type tractor shown in FIG. 1, or any other type of mobile machine, as well as any other type of nonmobile machine.

As shown in FIG. 1, the machine 100 includes a frame 102 that supports an engine 104, a drive system 106, a drive shaft 108, and a traction system 110. The machine 100 further includes operator controls 112 that interact with a control device 114 to control an implement 116.

The engine 104 is configured to supply power to the machine 100. The engine 104 may be an internal combustion engine (for example, a compression ignition engine), but in general, the engine 104 may be any prime mover that provides power to various systems of the machine 100. The engine 104 may be fueled by such fuels as distillate diesel fuel, biodiesel, dimethyl ether, gaseous fuels (such as hydrogen, natural gas, and propane), alcohol, ethanol, and/or any combination thereof.

The engine 104 is configured to provide operating power for operation of the implement 116 via, for example, the drive system 106, the drive shaft 108, and/or the like. The engine 104 is operably arranged to receive commands from the operator controls 112 and/or the control device 114. Additionally, the engine 104 is operably arranged with the implement 116 to operate the implement 116 according to the commands received from the operator controls 112 and/or the control device 114.

The drive system 106 is movably connected to the engine 104 via the drive shaft 108 to operate the implement 116 and to propel the machine 100 (e.g., via the traction system 110). The traction system 110 includes a track-drive system, a wheel-drive system, or any other type of drive system configured to propel the machine 100.

Figure 2:
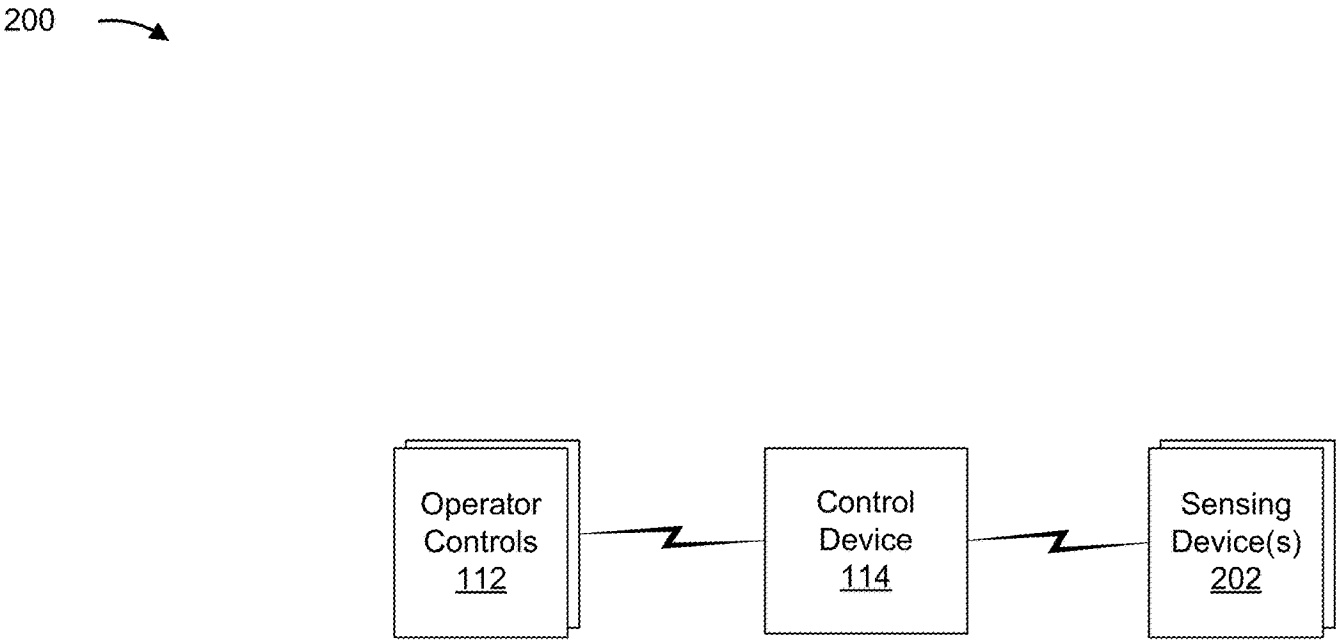
FIG. 2 is a diagram of an example environment described herein.

The operator controls 112 are operably connected to the control device 114 and are configured to generate commands to move the implement 116, as further described herein in relation to FIG. 2. The control device 114 is also configured to generate commands to move the implement 116 and/or to determine whether the implement 116 has settled at a set position, as further described herein in relation to FIG. 2.

The implement 116 is operably arranged with the engine 104 such that the implement 116 is movable through the commands transmitted from the operator controls 112 and/or the control device 114 to the engine 104. The illustrated implement 116 is a blade that can move up and down, tilt left and right, and/or the like. Other embodiments can include any other suitable implement for performing a variety of tasks, including, for example, ripping, dozing, brushing, compacting, grading, lifting, loading, plowing, and/or the like. Example implements 116 include rippers, augers, buckets, breakers/hammers, brushes, compactors, cutters, forked lifting devices, grader bits and end bits, grapples, and/or the like.

As indicated above, FIG. 1 is provided as an example. Other examples may differ from what is described in connection with FIG. 1.

FIG. 2 is a diagram of an example environment 200 in which systems and/or methods described herein may be implemented. As shown in FIG. 2, environment 200 includes the operator controls 112, the control device 114, one or more sensing devices 202, and/or the like. Devices of environment 200 may interconnect via wired connections, wireless connections, or a combination of wired and wireless connections.

The operator controls 112 may include one or more implement control devices, such as a dial, a knob, a slider, a joystick, and/or the like to control movement of the implement 116. The operator controls 112 are configured to generate one or more commands to move the implement 116.

The control device 114 may be a controller, an electronic control unit (ECU), and/or the like of the machine 100. The control device 114 may be implemented as a processor, such as a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), and/or another type of processing component. The processor may be implemented in hardware, firmware, and/or a combination of hardware and software. The control device 114 may include one or more processors capable of being programmed to perform a function. One or more memories, including a random-access memory (RAM), a read only memory (ROM), and/or another type of dynamic or static storage device (e.g., a flash memory, a magnetic memory, and/or an optical memory) may store information and/or instructions for use by the control device 114. The control device 114 may include a memory (e.g., a non-transitory computer-readable medium) capable of storing instructions that, when executed, cause the processor to perform one or more processes and/or methods described herein. The control device 114 is configured to generate one or more commands to move the implement 116 and/or to determine whether the implement 116 has settled at a set position.

The one or more sensing devices 202 (referred to singularly as "sensing device 202" and collectively as "sensing devices 202") include any type of sensor configured to measure a position of the implement 116 (e.g., in terms of height, angle, rotation angle, and/or the like). For example, the one or more sensing devices 202 may include a global positioning system (GPS) device, a local positioning system (LPS) device, an inertial measurement unit (IMU) device, and/or the like to detect a position of the implement 116. The one or more sensing devices 202 are configured to send (e.g., directly or via one or more other components or devices of the machine 100) position information concerning the implement 116 to the control device 114 (e.g., on a scheduled basis, on a triggered basis, on an on-demand basis, and/or the like).

In some implementations, an operator of the operator controls 112 (or an automated device) interacts with (e.g., moves, slides, rolls, pushes, and/or the like) the one or more implement control devices of the operator controls 112 to calibrate the implement 116. For example, as part of a calibration process, the operator may interact with the one or more implement control devices of the operator controls 112 to generate a command to move (e.g., to change a position of) the implement 116 to a set position. The command may indicate that the implement 116 is to move to the set position and/or stay at the set position for at least a threshold amount of time (e.g., to determine a noise band, to determine whether the implement 116 has settled, and/or the like, as described herein). Additionally, or alternatively, the control device 114 may generate (e.g., automatically generate, based on an algorithm) the command. In this way, the control device 114 may automatically generate commands to calibrate and/or test a calibration of the implement 116 without the operator needing to interact with the operator controls 112.

The operator controls 112 and/or the control device 114 may send the command to the engine 104 and/or the implement 116 to cause the implement 116 to move to the set position. The implement 116 may stay at the set position for at least the threshold amount of time indicated by the command and/or until the control device 114 determines that the implement 116 has settled at the set position.

After the implement 116 has moved to the set position, the one or more sensing devices 202 may collect data related to the implement 116 being at the set position. Additionally, or alternatively, the one or more sensing devices 202 may collect the data related to the implement 116 being at the set position after the operator controls 112 and/or the control device 114 cease sending commands to the engine 104 and/or the implement 116 to move the implement 116. The data may include a plurality of data elements, such as a plurality of position measurements (e.g., a plurality of height measurements of the implement 116, a plurality of angle measurements of the implement 116, a plurality of rotation angle measurements, and/or the like). Because of vibrations related to operation of the machine 100 and/or components of the machine 100, the plurality of position measurements may be different from each other, even though the implement 116 is configured to stay at the set position (e.g., configured to be stationary at the set position). Accordingly, the data may concern a plurality of positions (e.g., a plurality of heights, a plurality of angles, and/or the like) of the implement 116.

The one or more sensing devices 202 may send the data to the control device 114 (e.g., on a scheduled basis, on a triggered basis, on an on-demand basis, and/or the like). In some implementations, the one or more sensing devices 202 may send the data (e.g., as a data stream, as a signal, and/or the like) to the control device 114 as the one or more sensing devices 202 collect the data (e.g., in real-time). For example, the one or more sensing devices 202 may send a position measurement of the implement 116 one time interval at a time (e.g., every 10 milliseconds, every 100 milliseconds, every 0.5 seconds, every two seconds, and/or the like). Each time interval may cover an equal length of time and each time interval may be associated with a position of the implement 116 during the time interval.

The control device 114 may receive the data from the one or more sensing devices 202 (e.g., one position measurement per time interval). The control device 114 may process (e.g., parse) the data (e.g., in real-time) to identify a particular position measurement of the implement 116 and a particular time interval associated with the particular position measurement (e.g., a most recent position measurement and a time interval when the most recent position measurement was captured). The control device 114 may store the particular position measurement of the implement 116 and/or the particular time interval as part of an entry in a data structure. For example, the control device 114 may cause the data structure to store an entry that includes information that indicates the particular position measurement of the implement 116, the particular time interval, and/or the like.

The data structure may be configured to store a particular amount of recent entries (e.g., 20 entries, 50 entries, 100 entries, and/or the like) associated with the data received from the sensing devices 202. For example, the data structure may be a queue, such as a circular buffer, that overwrites the oldest entry in the queue when the queue is full and a new entry is added to the queue. In some implementations, the data structure may be associated with a time period. For example, where a length of a time interval of an entry is 10 milliseconds and the data structure is configured to store 50 entries, the time period is 500 milliseconds.

After identifying the particular position measurement of the implement 116, the control device 114 may determine (e.g., in real-time) a difference between the particular position measurement of the implement 116 and a position measurement of the implement 116 included in an existing entry of the data structure (e.g., an existing entry of the data structure associated with a most recent time interval that precedes the particular time interval). The control device 114 may determine a direction of movement of the implement 116 (e.g., during the particular time interval) based on the difference. For example, when the difference is positive, the control device 114 may determine that the implement 116 is moving in a positive direction; when the difference is negative, the control device 114 may determine that the implement 116 is moving in a negative direction; and/or when the difference is zero, the control device 114 may determine that the implement 116 is not moving in any direction. The control device 114 may cause the data structure to include the determined direction of movement of the implement 116 in the particular entry (e.g., the particular entry that includes the information that indicates the particular position measurement of the implement 116, the particular time interval, and/or the like) stored in the data structure.

In some implementations, the control device 114 may determine and/or identify one or more noise amplitudes associated with the data. A noise amplitude may be a difference between a maximum position measurement and a minimum position measurement of a set of position measurements (e.g., in consecutive, chronological order), of the plurality of position measurements of the data, where each position measurement of the set is associated with the same direction of movement of the implement 116. Examples of noise amplitudes are described herein in relation to FIG. 3.

The control device 114 may determine and/or identify the one or more noise amplitudes associated with the data by processing the plurality of entries of the data structure. For example, the control device 114 may identify a particular entry of the data structure associated with a particular direction of movement (e.g., the information included in the particular entry indicates the particular direction of movement). The control device 114 may identify the particular entry as the beginning of a sequence and may determine whether one or more additional entries that consecutively follow the particular entry are part of the sequence. The control device 114 may identify an additional entry as part of the sequence when the additional entry is associated with the particular direction of movement of the implement 116.

Additionally, or alternatively, when the additional entry is associated with a different direction of movement of the implement 116, the control device 114 may identify a number of consecutive additional entries associated with the different direction of movement of the implement 116 that precede the additional entry. When the number does not satisfy (e.g., is less than) a threshold, the control device 114 may identify the additional entry as part of the sequence. When the number satisfies (e.g., is greater than or equal to) the threshold, the control device 114 may identify an entry that precedes the consecutive additional entries as the end of the sequence. The control device 114 may process the remaining entries of the data structure in a similar way to determine and/or identify the one or more sequences.

After the control device 114 has identified and/or determined the one or more sequences, the control device 114 may, for each sequence, identify a first entry of the sequence associated with a maximum position value (e.g., an entry with a position value that is greater than or equal to the respective position values of the other entries of the sequence) and a second entry of the sequence associated with a minimum position value (e.g., an entry with a position value that is less than or equal to the respective position values of the other entries of the sequence). The control device 114 may determine a difference between the maximum position value of the first entry and the minimum position value of the second entry. The difference may be a noise amplitude associated with the sequence. In this way, the control device 114 may process the one or more sequences to respectively identify and/or determine the one or more noise amplitudes.

After determining the one or more noise amplitudes, the control device 114 may determine a noise amplitude average value (e.g., a mean, a weighted average, a median, and/or the like) related to the one or more noise amplitudes. For example, the control device 114 may determine a sum of the one or more noise amplitudes, and a number of noise amplitudes of the one or more noise amplitudes, and may determine the noise amplitude average value by dividing the sum by the number of noise amplitudes.

After determining the noise amplitude average value, the control device 114 may determine a noise amplitude standard deviation value related to the one or more noise amplitudes. In some implementations, the control device 114 may calculate a standard deviation of the noise amplitude average value and may determine the noise amplitude standard deviation value based on the standard deviation of the noise amplitude average value. For example, the control device 114 may cause the noise amplitude standard deviation value to be the standard deviation, two standard deviations, three standard deviations, and/or the like of the noise amplitude average value.

The control device 114 may determine a noise band (e.g., related to the implement 116 being at the set position, vibrating at the set position, and/or the like). In some implementations, the control device 114 may determine a noise band width based on the noise amplitude standard deviation value. For example, the control device 114 may cause the noise band width to be a percentage (e.g., 75%, 90%, 100%, 110% and/or the like) of the noise amplitude standard deviation value. In some implementations, the control device 114 may determine a noise band center based on the set position. For example, the control device 114 may cause the noise band center to be the set position. The control device 114 may generate the noise band to have the noise band width and/or the noise band center.

After determining the noise band, the control device 114 may determine and/or identify one or more additional noise amplitudes associated with the data. The control device 114 may determine and/or identify the one or more additional noise amplitudes associated with the data by processing a set of entries, of the plurality of entries, of the data structure in a similar manner as described herein. For example, the control device 114 may process the set of entries to identify one or more sequences and may identify and/or determine the one or more noise amplitudes associated with the set of entries based on the one or more sequences.

The set of entries may be the 5 most recent entries, the 10 most recent entries, the 20 most recent entries, and/or the like that have been added to the data structure. In some implementations, the plurality of entries of the data structure may be associated with a first time period (e.g., a most recent 500 millisecond period) and the set of entries of the data structure may be associated with a second time period (e.g., a most recent 100 millisecond period) where a start of the second time period occurs after a start of the first time period. The second time period may be a sub-period of the first period (e.g., the second period is coextensive with part of the first period).

In some implementations, the control device 114 may determine whether the implement 116 has settled at the set position (e.g., the implement 116 has stopped vibrating at the set position due to movement of the implement 116 to the set position). For example, the control device 114 may determine that the implement 116 has settled at the set position when a threshold number of noise amplitudes (e.g., 2, 3, 5, 10, and/or the like amplitudes), of the one or more additional noise amplitudes, are within the noise band (e.g., a respective minimum position value and a respective maximum position value of each noise amplitude, of the threshold number of noise amplitudes, are within the noise band). Additionally, or alternatively, the control device 114 may determine that the implement 116 has settled at the set position when a set of the one or more additional noise amplitudes are within the noise band for a threshold period of time (e.g., 10 milliseconds, 100 milliseconds, 500 milliseconds, and/or the like).

In some implementations, the control device 114 may process the one or more additional noise amplitudes to facilitate determining whether the implement 116 has settled at the set position. For example, the control device 114 may determine a noise amplitude average value associated with the one or more additional noise amplitudes and a noise amplitude standard deviation value of the one or more additional noise amplitudes in a similar manner as described herein. The control device 114 may determine that the implement 116 has settled at the set position when the noise amplitude standard deviation value of the one or more additional noise amplitudes is less than or equal to the width of the noise band. Additionally, or alternatively, the control device 114 may determine the implement 116 has settled at the set position when the noise amplitude standard deviation value of the one or more additional noise amplitudes is less than or equal to the width of the noise band for a threshold period of time (e.g., 10 milliseconds, 100 milliseconds, 500 milliseconds, and/or the like).

After the control device 114 determines that the implement 116 has settled at the set position, the control device 114 may allow and/or permit the implement 116 to move to another position (e.g., another set position). For example, the control device 114 may determine an amount of time that the implement 116 remained at the set position (e.g., based on the operator controls 112 and/or the control device 114 sending the command to the engine 104 and/or the implement 116 to cause the implement 116 to move to the set position). The control device 114 may determine that the amount of time that the implement 116 remained at the set position is greater than the threshold amount of time indicated by the command (e.g., which may indicate that the control device 114 had enough time to accurately determine that the implement 116 has settled at the set position). Accordingly, the control device 114 may send a new command to the engine 104 and/or the implement 116 to cause the implement 116 to move to a new set position. Additionally, or alternatively, the control device 114 may send a message to the operator controls 112 indicating that the operator controls may send a new command to move the implement 116 from the set position.

As indicated above, FIG. 2 is provided as an example. Other examples may differ from what is described in connection with FIG. 2.

Figure 3:
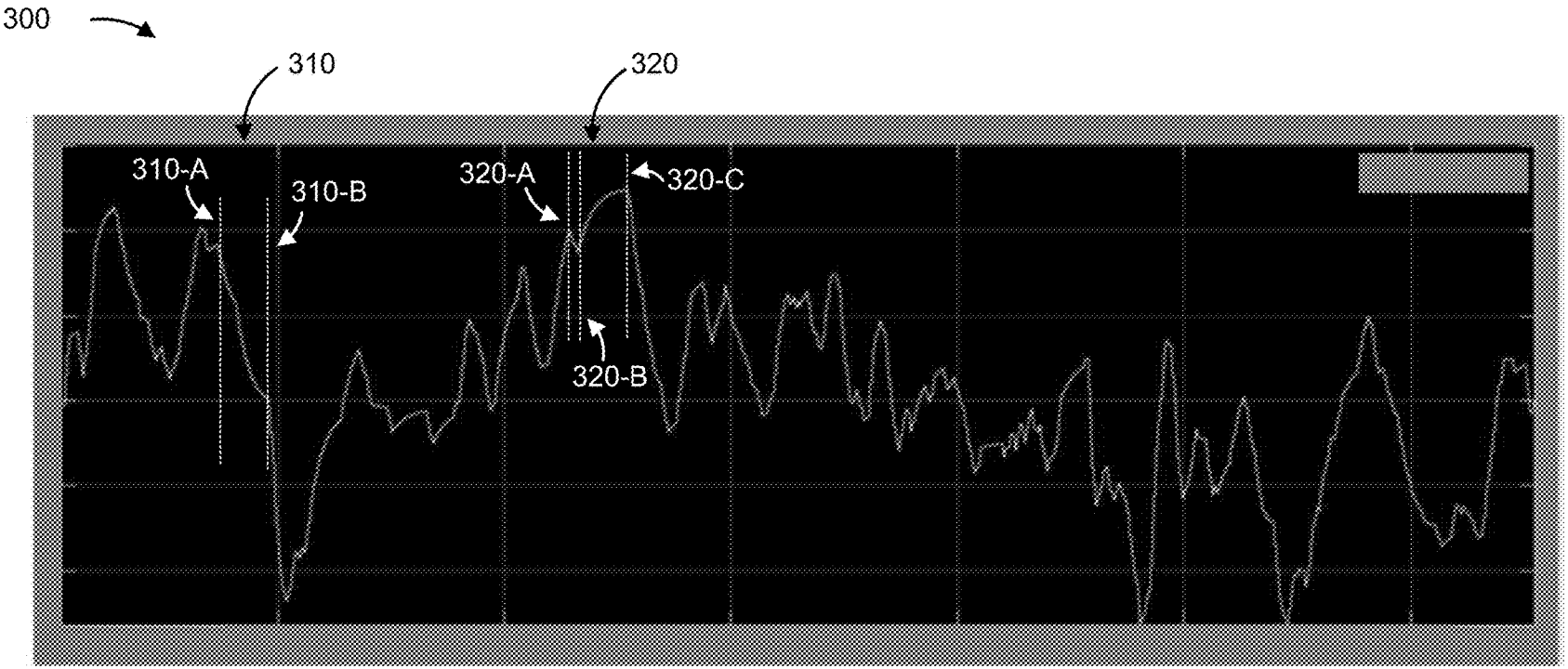
FIG. 3 is a diagram illustrating example sequences and example noise amplitudes described herein.

FIG. 3 is a diagram 300 illustrating example sequences and example noise amplitudes described herein. As shown in FIG. 3, the diagram 300 shows position measurements of the implement 116 (e.g., in millimeters, centimeters, meters, and/or the like) over time (e.g., in milliseconds, seconds, and/or the like). The control device 114 may determine and/or identify a sequence 310 in a similar manner as described herein. The sequence 310 may begin at a time 310-A and end at a time 310-B. The sequence 310 may comprise one or more position measurements and may be associated with a direction of movement (e.g., shown in FIG. 3 as a negative direction of movement). The control device 114 may determine a noise amplitude associated with the sequence 310 in a similar manner as described herein. The noise amplitude may be a difference between a maximum position measurement of the implement 116 (e.g., at time 310-A) and a minimum position measurement of the implement 116 (e.g., at time 310-B) in the sequence 310.

Similarly, the control device 114 may determine and/or identify a sequence 320 in a similar manner as described herein. The sequence 320 may begin at a time 320-A and end at a time 320-C. The sequence 310 may comprise one or more position measurements and may be associated with a direction of movement (e.g., shown in FIG. 3 as a positive direction of movement even though there is a small negative direction of movement between time 320-A and a time 320-B). The control device 114 may determine a noise amplitude associated with the sequence 320 in a similar manner as described herein. The noise amplitude may be a difference between a maximum position measurement of the implement 116 (e.g., at time 320-C) and a minimum position measurement of the implement 116 (e.g., at time 320-B) in the sequence 320.

As indicated above, FIG. 3 is provided as an example. Other examples may differ from what is described in connection with FIG. 3.

Figure 4:
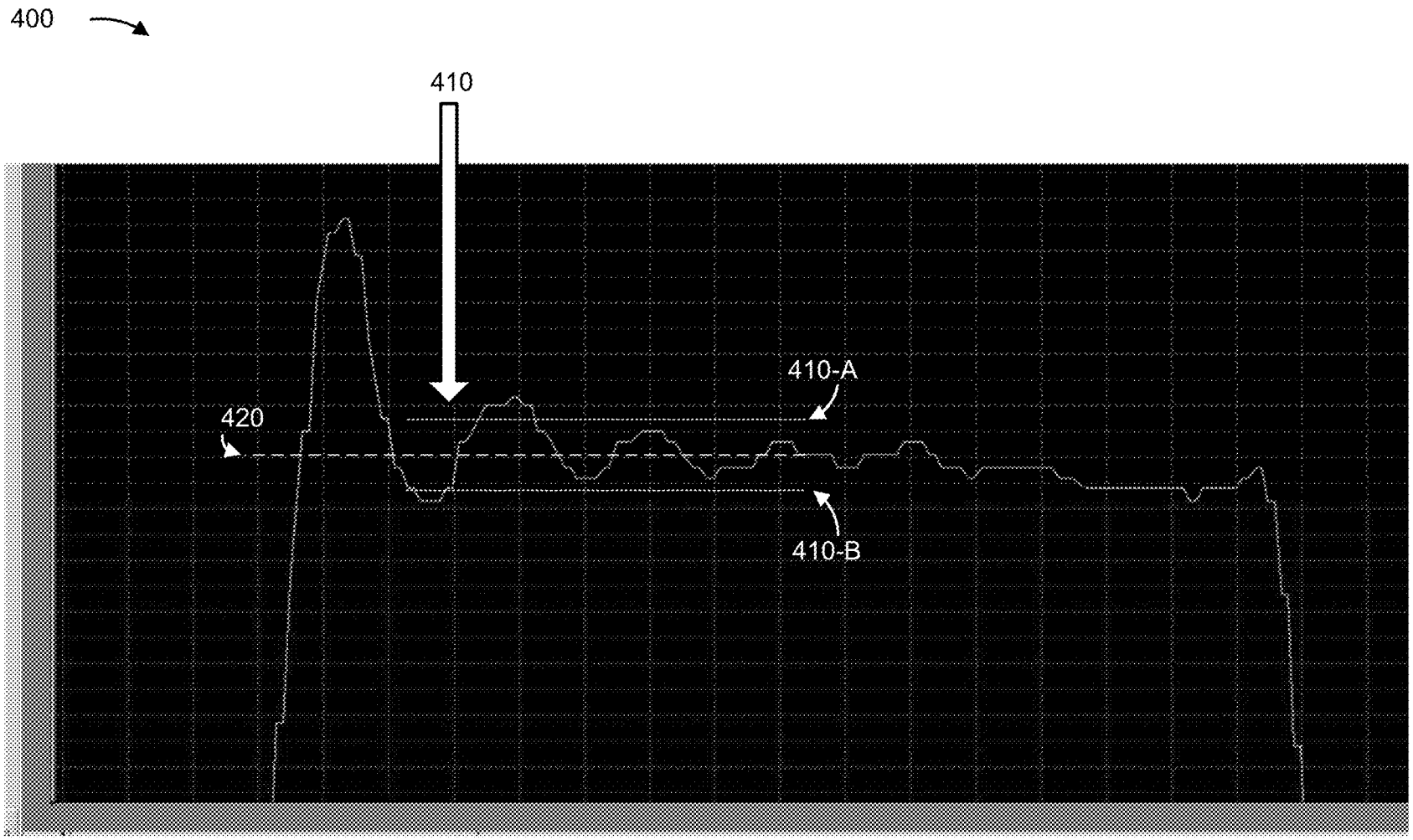
FIG. 4 is a diagram illustrating an example noise band described herein.

FIG. 4 is a diagram 400 illustrating an example noise band described herein. As shown in FIG. 4, the diagram 300 shows position measurements of the implement 116 (e.g., in millimeters, centimeters, meters, and/or the like) over time (e.g., in milliseconds, seconds, and/or the like). The control device 114 may determine and/or identify a noise band 410 in a similar manner as described herein. The noise band 410 may have an upper bound 410-A and a lower bound 410-B. A width of the noise band 410 may be defined by a difference between the upper bound 410-A and the lower bound 410-B. The noise band may be centered around a set position 420 of the implement 116.

As indicated above, FIG. 4 is provided as an example. Other examples may differ from what is described in connection with FIG. 4.

Figure 5:
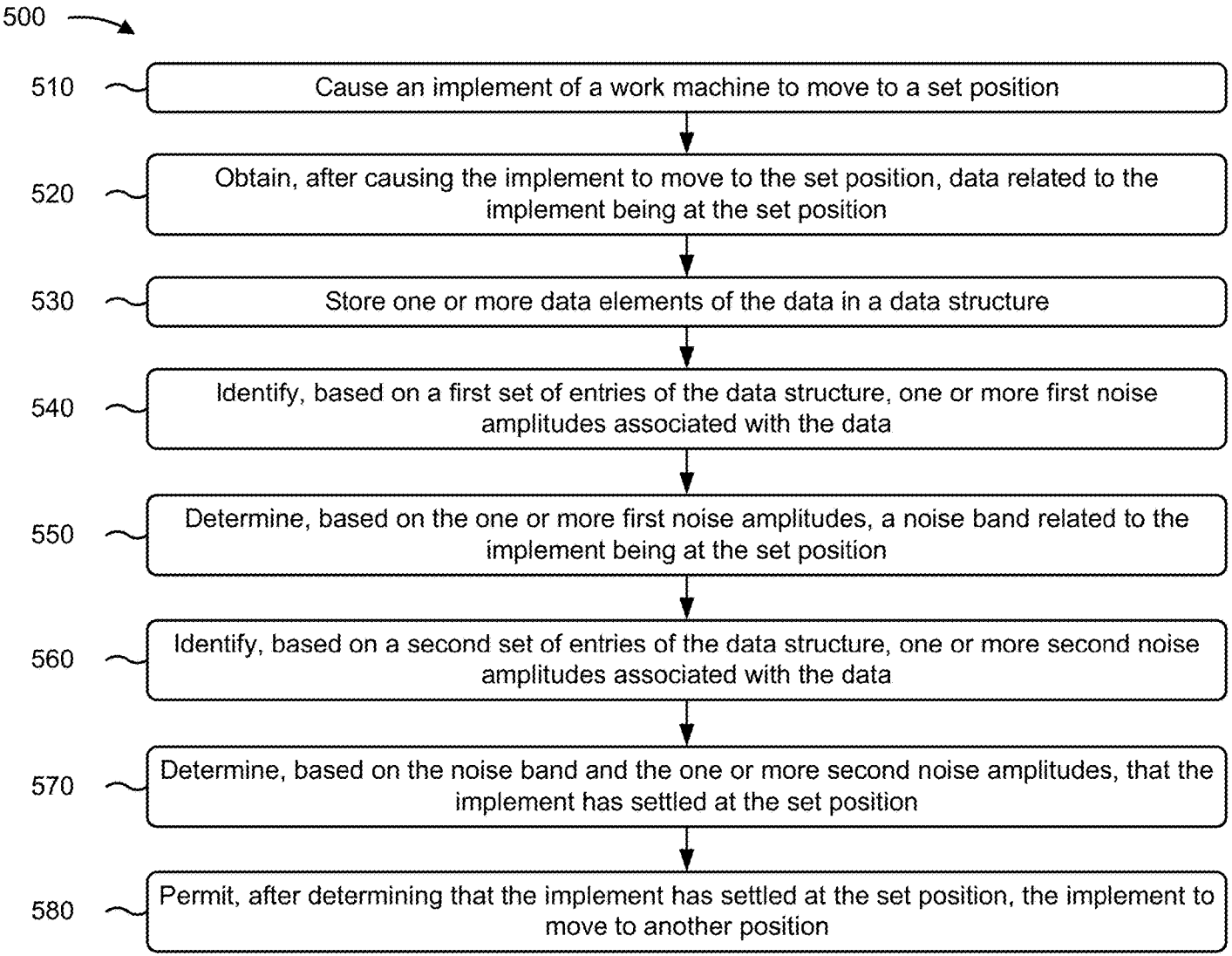
FIG. 5 is a flowchart of an example process for determining that an implement of a work machine has settled at a set position.

FIG. 5 is a flow chart of an example process 500 for determining that an implement of a work machine has settled at a set position. One or more process blocks of FIG. 5 may be performed by a control device (e.g., control device 114). One or more process blocks of FIG. 5 may be performed by another device or a group of devices separate from or including the control device, such as operator controls (e.g., operator controls 112), sensing devices (e.g., sensing devices 202), and/or the like.

As shown in FIG. 5, process 500 may include causing an implement of a work machine to move to a set position (block 510). For example, the control device may cause an implement of a work machine to move to a set position, as described above.

As further shown in FIG. 5, process 500 may include obtaining, after causing the implement to move to the set position, data related to the implement being at the set position (block 520). For example, the control device may obtain, after causing the implement to move to the set position, data related to the implement being at the set position, as described above.

As further shown in FIG. 5, process 500 may include storing one or more data elements of the data in a data structure (block 530). For example, the control device may store one or more data elements of the data in a data structure, as described above. The one or more data elements may include a position measurement of the implement and/or a time interval associated with the position measurement. Each data element may be included in a respective entry in the data structure.

As further shown in FIG. 5, process 500 may include identifying, based on a first set of entries of the data structure, one or more first noise amplitudes associated with the data (block 540). For example, the control device may identify, based on a first set of entries of the data structure, one or more first noise amplitudes associated with the data, as described above.

As further shown in FIG. 5, process 500 may include determining, based on the one or more first noise amplitudes, a noise band related to the implement being at the set position (block 550). For example, the control device may determine, based on the one or more first noise amplitudes, a noise band related to the implement being at the set position, as described above.

As further shown in FIG. 5, process 500 may include identifying, based on a second set of entries of the data structure, one or more second noise amplitudes associated with the data (block 560). For example, the control device may identify, based on a second set of entries of the data structure, one or more second noise amplitudes associated with the data, as described above.

As further shown in FIG. 5, process 500 may include determining, based on the noise band and the one or more second noise amplitudes, that the implement has settled at the set position (block 570). For example, the control device may determine, based on the noise band and the one or more second noise amplitudes, that the implement has settled at the set position, as described above.

As further shown in FIG. 5, process 500 may include permitting, after determining that the implement has settled at the set position, the implement to move to another position (block 580). For example, the control device may permit, after determining that the implement has settled at the set position, the implement to move to another position, as described above.

Process 500 may include additional implementations, such as any single implementation or any combination of implementations described in connection with one or more other processes described elsewhere herein.

Although FIG. 5 shows example blocks of process 500, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The disclosed control device (e.g., the control device 114) may be used to facilitate calibration of any implement of any work machine. The control device is able to identify one or more first noise amplitudes associated with data comprising a plurality of position measurements of the implement after the implement has moved to a set position. The control device determines, based on the one or more first noise amplitudes, a noise band related to the implement vibrating at the set position. The control device then identifies one or more second noise amplitudes associated with the data and may determine, based on the noise band and the one or more second noise amplitudes, that the implement has settled at the set position. Accordingly, based on determining that the implement has settled at the set position, the control device allows the implement to move to another position.

In this way, the control device is able to accurately determine when the implement has settled at the set position, even when the data is noisy. Moreover, the control device is able to cause the implement to move to a new set position as soon as the implement settles at the set position, rather than wait a fixed, longer amount of time for the implement to settle. In a calibration process that requires the implement to be moved between dozens or hundreds of set positions, this may substantially reduce an amount of time to calibrate the implement. Further, the control device ensures that the implement is given as much time as needed to settle at the set position before moving to a new position, which may enable a more accurate position measurement of the implement 116 at the set position to be captured. This may improve a calibration of the implement 116, which may improve a performance of the implement.

What is claimed is:

1. A method, comprising:

obtaining data related to at least one position of an implement of a work machine that has moved to a set position;

identifying one or more first noise amplitudes associated with the data;

determining, based on the one or more first noise amplitudes, a noise band related to the implement vibrating at the set position;

identifying one or more second noise amplitudes associated with the data;

determining, based on the noise band and the one or more second noise amplitudes, that the implement has settled at the set position; and allowing, based on determining that the implement has settled at the set position, the implement to move to another position.

2. The method of claim 1, wherein obtaining the data comprises:

obtaining the data from one or more sensing devices associated with the implement;

identifying a position measurement of the implement included in the data;

identifying a time interval associated with the position measurement;

determining, based on the position measurement, a direction of movement of the implement during the time interval; and causing a data structure to store an entry that includes information that indicates the position measurement of the implement, the time interval, and the direction of movement of the implement.

3. The method of claim 1, wherein identifying the one or more first noise amplitudes associated with the data comprises:

identifying one or more entries of a data structure that is configured to store information associated with the data, wherein each entry, of the one or more entries, includes respective information that indicates a position measurement of the implement at a time interval and a direction of movement of the implement during the time interval;

processing the one or more entries to identify one or more sequences of entries, wherein each sequence, of the one or more sequences, is associated with a respective direction of movement of the implement; and determining, based on the one or more sequences, the one or more first noise amplitudes associated with the data.

4. The method of claim 3, wherein determining the one or more first noise amplitudes associated with the data comprises:

determining, for each sequence of the one or more sequences, a difference between a first entry of the sequence associated with a maximum position value and a second entry of the sequence associated with a minimum position value; and determining, based on the respective difference of each sequence of the one or more sequences, the one or more first noise amplitudes.

5. The method of claim 1, wherein determining the noise band related to the implement vibrating at the set position comprises:

determining, based on the one or more first noise amplitudes, a noise amplitude average value;

determining, based on the noise amplitude average value, a noise amplitude standard deviation value; and determining, based on the noise amplitude standard deviation value, the noise band.

6. The method of claim 1, wherein the noise band has a width based on two standard deviations of a noise amplitude average value of the one or more first noise amplitudes.

7. The method of claim 1, wherein identifying the one or more second noise amplitudes associated with the data comprises:

identifying one or more entries of a data structure that is configured to store information associated with the data, wherein each entry, of the one or more entries, includes respective information indicating a position measurement of the implement;

processing a set of entries, of the one or more entries, to identify one or more sequences of entries that are respectively associated with a direction of movement of the implement; and processing the one or more sequences of entries to identify the one or more second noise amplitudes associated with the data.

8. The method of claim 7, wherein processing the set of entries, of the one or more entries, to identify the one or more sequences of entries that are respectively associated with a direction of movement of the implement comprises:

identifying a first entry, of the set of entries, that includes information indicating a first direction of movement of the implement;

determining that the first entry is part of a sequence;

identifying a second entry, of the set of entries, that includes information indicating a second direction of movement of the implement;

determining a number of other consecutive entries of the sequence that precede the second entry, wherein each other entry includes information indicating the second direction of movement of the implement; and determining that the second entry is part of the sequence when the number satisfies a threshold; or determining that the second entry is part of a different sequence when the number does not satisfy the threshold.

9. The method of claim 1, wherein determining that the implement has settled at the set position comprises:

determining, based on the one or more second noise amplitudes, a noise amplitude average value;

determining, based on the noise amplitude average value, a noise amplitude standard deviation value;

determining that the noise amplitude standard deviation value is less than or equal to a width of the noise band; and determining, based on determining that the noise amplitude standard deviation value is less than or equal to the width of the noise band, that the implement has settled at the set position.

10. The method of claim 1, wherein determining that the implement has settled at the set position comprises:

determining, based on a noise amplitude average value of the one or more second noise amplitudes, a noise amplitude standard deviation value;

determining that the noise amplitude standard deviation value is less than or equal to a width of the noise band for a threshold period of time; and determining, based on determining that the noise amplitude standard deviation value is less than or equal to the width of the noise band for the threshold period of time, that the implement has settled at the set position.

11. The method of claim 1, wherein determining that the implement has settled at the set position comprises:

determining that a threshold number of noise amplitudes, of the one or more second noise amplitudes, are within the noise band; and determining, based on determining that the threshold number of noise amplitudes are within the noise band, that the implement has settled at the set position.

12. The method of claim 1, wherein allowing the implement to move to the other position comprises:

sending a command to the implement to move the implement from the set position to the other position.

13. A method, comprising:

obtaining a signal that includes a plurality of signal values associated with a component;

identifying one or more first noise amplitudes associated with the signal;

determining, based on the one or more first noise amplitudes, a noise band related to the signal;

identifying one or more second noise amplitudes associated with the signal;

determining, based on the noise band and the one or more second noise amplitudes, that the signal has settled at a particular signal value; and permitting, after determining that the signal has settled at a particular signal value, the component to move from a first position to a second position.

14. The method of claim 13, wherein the component is an implement of a work machine and the signal is associated with a plurality of positions of the implement.

15. The method of claim 13, wherein obtaining the signal comprises:

obtaining the signal one signal value at a time from one or more sensing devices; and storing each signal value, of the plurality of signal values, in a data structure.

16. The method of claim 13, wherein identifying the one or more first noise amplitudes associated with the signal comprises:

identifying a plurality of entries in a data structure, wherein each entry includes information indicating a respective signal value of the signal;

processing the plurality of entries of the data structure to identify one or more sequences of entries;

wherein each sequence is associated with a respective direction of movement of the signal; and determining, based on the one or more sequences of entries, the one or more first noise amplitudes.

17. A method, comprising:

causing an implement of a work machine to move to a set position;

obtaining, after causing the implement to move to the set position, data related to the implement being at the set position;

storing one or more data elements of the data in a data structure, wherein each data element is included in a respective entry in the data structure;

identifying, based on a first set of entries of the data structure, one or more first noise amplitudes associated with the data;

determining, based on the one or more first noise amplitudes, a noise band related to the implement being at the set position;

identifying, based on a second set of entries of the data structure, one or more second noise amplitudes associated with the data, determining, based on the noise band and the one or more second noise amplitudes, that the implement has settled at the set position; and permitting, after determining that the implement has settled at the set position, the implement to move to another position.

18. The method of claim 17, wherein causing the implement to move to the set position comprises:

generating a command to move the implement to the set position, wherein the command indicates that the implement is to stay at the set position for at least a threshold amount of time; and sending the command to the implement to cause the implement to move to the set position.

19. The method of claim 17, wherein permitting the implement to move to the other position comprises:

determining, after determining that the implement has settled at the set position, an amount of time that the implement has stayed at the set position;

generating, based on determining that the amount of time is greater than a threshold amount of time, a command to move the implement to the other position; and sending the command to the implement to cause the implement to move to the other position.

20. The method of claim 17, wherein determining the noise band related to the implement being at the set position comprises:

determining, based on the one or more first noise amplitudes, a noise amplitude average value;

determining, based on the noise amplitude average value, a noise amplitude standard deviation value;

determining, based on the noise amplitude standard deviation value, a noise band width;

determining, based on the set position, a noise band center; and generating, based on the noise band width and the noise band center, the noise band.

* * * * *